United States Patent [19]

Keizer et al.

[11] Patent Number: 4,749,303

[45] Date of Patent: Jun. 7, 1988

[54] HEATER FOR ASPHALT PAVEMENT OR THE LIKE

[76] Inventors: Gregory J. Keizer, 2105 McKail Rd., Leonard, Mich. 48038; Carl W. Morris, 2609 Thornbury La., Almont, Mich. 48003

[21] Appl. No.: 860,847

[22] Filed: May 8, 1986

[51] Int. Cl.[4] ..... E01C 23/14

[52] U.S. Cl. ..... 404/86; 404/95; 126/271.2 A

[58] Field of Search ..... 404/77, 79, 85, 86, 404/95; 126/271.1, 271.2 A, 271.2 R; 280/641; 501/95

[56] References Cited

U.S. PATENT DOCUMENTS

| | | | |
|---|---|---|---|
| 2,754,127 | 7/1956 | Owens, Sr. | 280/641 |
| 3,055,280 | 9/1962 | Neville | 404/95 |
| 3,179,156 | 4/1965 | Weiss et al. | 501/95 X |
| 3,383,159 | 5/1968 | Smith, Jr. | 501/95 X |
| 3,801,212 | 4/1974 | Cutler | 404/77 X |
| 3,807,886 | 4/1974 | Cutler | 404/77 |
| 3,865,098 | 2/1975 | Cutler | 126/271.2 A |
| 3,970,071 | 7/1976 | Miller et al. | 126/271.2 A |
| 4,129,398 | 12/1978 | Schoelkopt | 404/95 |
| 4,407,605 | 10/1983 | Wirtgen | 404/77 |

*Primary Examiner*—James A. Leppink
*Assistant Examiner*—Matthew Smith
*Attorney, Agent, or Firm*—Gifford, Groh, VanOphem, Sheridan, Sprinkle and Dolgorukov

[57] ABSTRACT

A lightweight surface heater suitable for repairing asphalt pavement, or the like, which conveniently folds for trailering. Air and gaseous fuel are mixed and forced down through refractory blanket to burn on its lower surface, radiating heat to the roadway. A hinged middle allows one half of the heater with trailer tongue and tires attached to its top to be folded upside down underneath the other half during transport.

6 Claims, 2 Drawing Sheets

HEATER FOR ASPHALT PAVEMENT OR THE LIKE

BACKGROUND OF THE INVENTION

This invention relates generally to asphalt concrete repair apparatus and more particularly to heating units utilized to soften areas of asphalt pavement.

The idea of heating existing asphalt pavement where it lies on the roadway in order to rejuvenate and make repairs is an old one and a good one. It eliminates lifting and trucking the old asphalt away as well as buying all new asphalt concrete to truck in and spread.

A variety of asphalt heating machines have been produced. They have employed direct flame, steam, microwaves, infrared radiation, etc. to convey heat into the road surface. The best machine for this application would quickly and safely get the heat in for the lowest cost.

It was the intent of the inventor to produce an inexpensive and manuverable infrared heating machine that could effectively heat asphalt roadways. Experiments with forcing combustible air and gas mixture through refractory blanket showed that the blanket could be used as an efficient radiant surface burner medium. Its flexibility and lightweight ideally suited it to use in such a machine. The weight was so decreased by its use instead of rigid refractory material that it was possible to handle over 60 square feet of heating surface manually, eliminating the cost and weight of hydraulics or winches. Complete mobility of the heater speeded repairs and allowed them to be done at any angle relative to the plane of the road.

The light weight of the device makes possible the folding trailer enclosure for the heater. Lifting at the hinged middle folds the machine in half into the trailering position which protects the burner medium during transport and eliminates the need for a separate trailer. A separate trailer would be in the way behind the towing vehicle which may be advantageously used to carry asphalt. The reduction of weight makes the heater more useable and decreases its cost.

SUMMARY OF THE INVENTION

The object of this invention is to provide a new and improved apparatus for heating the upper surface of asphalt pavement in preparation for repairs.

Briefly, the heating apparatus is a folding infrared heating chamber with accompanying mechanisms which overlies the pavement to be heated. The chamber is constructed in two halves which are hinged together. Lifting the middle along the hinge joint stands the halves on edge and folds them together. A slight sideways pull tips the folded machine down onto the trailer tires and tongue which are permanently attached to what may now be called the bottom half. The upper half has a blower, control valves, and fuel tanks attached which supply both halves of the heating chamber with combustible air and fuel mixture through mixing channels and supply manifolds. Refractory ceramic fiber blanket lines the roof of both halves of the heating chamber. This blanket emits intense infrared radiation when the combustible mixture is forced down through it and burned along its lower surfaces.

Many other features and advantages of the invention will be more fully realized and understood from the following detailed description of the preferred embodiment when taken inconjunction with the accompanying drawings. Reference numerals throughout the various illustrations are intended to designate similar components or elements.

BRIEF DESCRIPTION OF THE DRAWINGS

FIG. 1 is a sideview of a folding asphalt heater in its folded out position as it would be while heating pavement.

FIG. 2 is a sideview of the machine in FIG. 1 midway between folded out and trailering positions.

FIG. 3 is a sideview of the machine in FIG. 1 and FIG. 2 in its trailering position as it would be while in tow.

FIG. 4 is a cross sectional view of the heating element which is incorporated in the folding asphalt heater.

DETAILED DESCRIPTION OF THE PREFERRED EMBODIMENT

Figure 1:
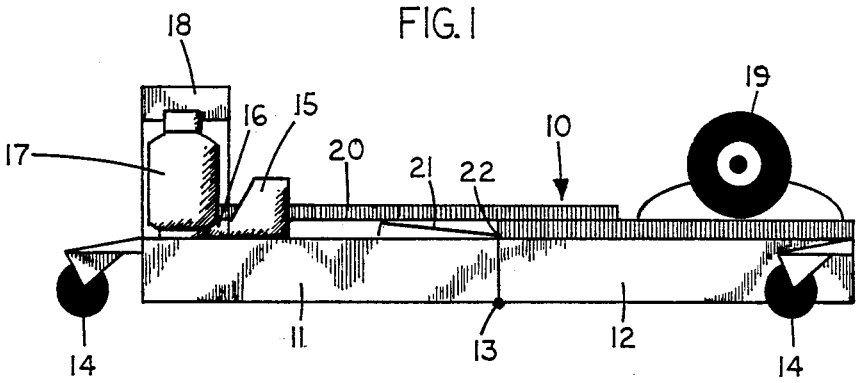
FIG. 1

Referring to FIG. 1 there is seen a side view of a folding asphalt heater that is generally designated by reference number 10. The folding asphalt heater 10 is constructed of two sections 11 and 12 held together by a hinge 13 between them. Castors 14 located on each of the four corners of the folding asphalt heater 10 allow manual positioning over the desired areas of pavement.

A blower 15 is run continuously to supply constant pressure air to an air channel 16 which is mounted on the top of section 11. Fuel such a propane is stored in removable tanks 17. The flow of fuel from the tanks 17 into the continuous air stream produced by the blower 15 is regulated by manually operated control valves located in the control panel 18 to produce a combustible mixture.

Two trailer tires 19 and a trailer tongue 20 are attached to the top of section 12. A cover 21 is attached by a hinge 22 to the corner of section 12 and rests on the top of section 11.

Figure 2:
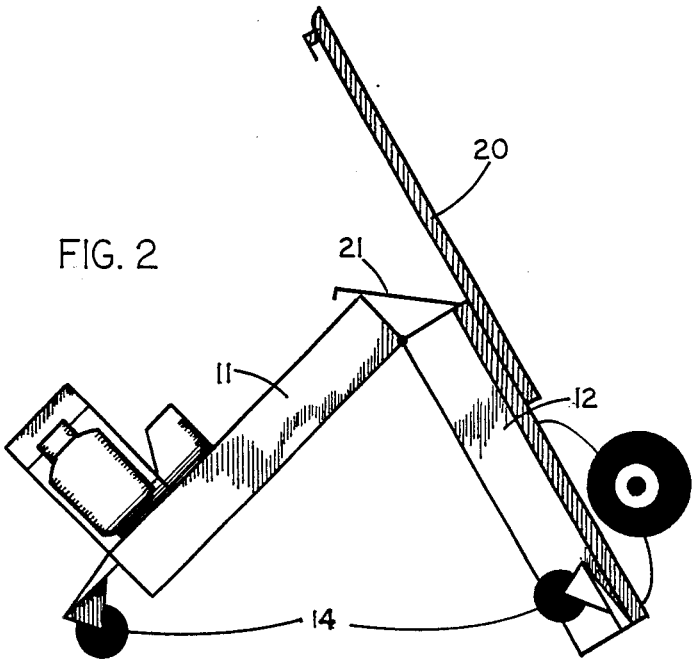
FIG. 2

Referring now to FIG. 2 the hinged middle of the folding asphalt heater 10 has been lifted to make clear the action of its various parts during folding. The trailer tongue 20 is protruding upward and the cover 21 is pivoting at its hinge 22. Section 12 is resting solidly on the ground while section 11 is rolling toward it on its castors 14.

Figure 3:
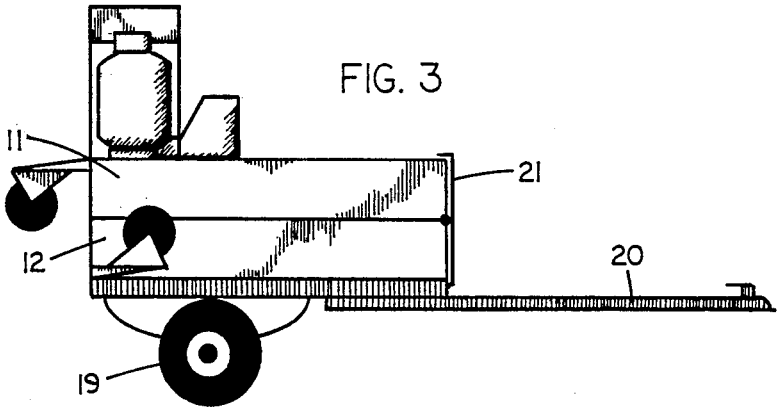
FIG. 3

Referring now to FIG. 3, sections 11 and 12 are together and have their combined weight supported by the trailer tires 19. The cover 21 is in place protecting the hinge ends of sections 11 and 12. The tongue 20 is protruding horizontally to be connected to a tow vehicle.

Figure 4:
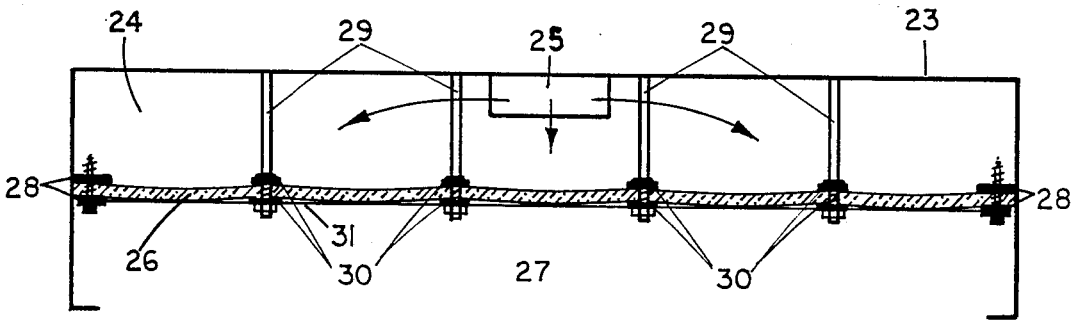
FIG. 4

Referring now to FIG. 4, there is seen a cross section view of either section 11 or 12. The outer shell 23 forms a manifold 24 where fuel/air combustible mixture delivered from the mixing channel 25 is able to slow down and evenly distribute its pressure throughout manifold 24. Ceramic fiber blanket 26 forms the floor of the manifold 24 and the roof of the heating chamber 27. The fuel/air combustible mixture is forced down through the micro spaces between the fibers in the ceramic fiber blanket 26 to be burned across its lower surface, radiating heat downward. The ceramic fiber blanket 26 is squeezed at its perimeter between rigid bars 28 the upper of which is attached to the outer shell 23. This effectively seals the edges of the blanket 26 while holding it in place. Shafts 29 attached to the outer shell 23 extend through the blanket 26. Washers 30 attached to the shafts 29 squeeze and secure the blanket 26 between them. Heat-and-oxidation-resistant nickel alloy wires 31 may be stretched between opposite sides of the lower rigid bars 28 to hold the blanket 26 in place.

What is claimed:

1. The equipment for heating the upper surface of asphalt pavement, or the like, comprising a two section heating chamber which overlies pavement to be heated, wheels attached to one of said sections, a trailer tongue also attached to said one section, a hinge connecting the other section to the one section and providing an extended position of said sections and a folded position of said sections, the trailer tongue extending outwardly of said one section and toward said other section when the sections are in the extended position, the other section being on top of the one section when the sections are in the folded position, the wheels and tongue facing in the upward direction when the sections are in the extended position and facing in the downward direction with the wheels engaging the highway in the section folded position, means supporting said sections and engaging the highway when the sections are in the extended position.

2. The equipment for heating the upper surface of asphalt pavement according to claim 1 including a rigid cover attached by a hinge to the top of said first section along the junction of said first and second sections so that when said first section is folded under said second section, said cover moves into a position over the otherwise exposed hinged side of the box formed by said first and second sections.

3. The equipment for heating the upper surface of asphalt pavement according to claim 1 including the attachment of castors too the outside corners of said sections which are useful both in positioning said heating chamber over pavement areas and in folding said first section under said second section.

4. The equipment for heating the upper surface of asphalt pavement according to claim 1 wherein said heating chamber has a roof and a layer of high temperature refractory fiber blanket lined across said roof, said blanket is sealed about its perimeter by pressure of rigid bars and held from bulging down by a grid of heat and oxidation resistant nickel alloy wire stretched between opposite sides of said bars, said fiber blankets form the boundry between said heating chamber where all combustion occurs and a pressurized gaseous combustible mixture supply manifold above where no combustion occurs so that combustible mixture is forced through said fiber blanket to burn on said blankets' ower surface thereby radiating heat to the pavement below.

5. The equipment for heating the upper surface of asphalt pavement according to claim 4 wherein the grid of heat and oxidation resistant wire is replaced for the purpose of holding said fiber blanket from bulging down by a plurality of shafts attached solidly to the underside of said combustible mixture manifold and extending through said fiber blanket with means at said junction to firmly attach to said fiber blanket.

6. The equipment for heating the upper surface of asphalt pavement according to claim 4 further including air supply blower means connected with said pressurized gaseous combustible mixture supply manifold by way of a channel with an inlet for gaseous fuel, such as propane, near said supply blower means and means to create turbulant flow within said channel to achieve thorough mixing of air and fuel.

* * * * *